US005881621A

United States Patent [19]

Dennis

[11] Patent Number: 5,881,621

[45] Date of Patent: Mar. 16, 1999

[54] FOOD PRODUCT SLICER

[76] Inventor: Clarence Dennis, 2332 Field Stone Dr., Mendota Heights, Minn. 55120

[21] Appl. No.: 933,626

[22] Filed: Sep. 19, 1997

[51] Int. Cl.[6] ..... B26D 1/10

[52] U.S. Cl. ..... 83/168; 83/762; 83/468.7; 83/167

[58] Field of Search ..... 83/167, 168, 761, 83/762, 468.7, 932, 870, 454

[56] References Cited

U.S. PATENT DOCUMENTS

| | | | |
|---|---|---|---|
| 252,325 | 1/1882 | Moore . | |
| 2,407,658 | 3/1946 | Fuchs et al. | 83/762 X |
| 4,249,445 | 2/1981 | Browning | 83/762 |
| 4,399,989 | 8/1983 | Baillie | 83/762 X |
| 4,662,257 | 5/1987 | Petersen et al. | 83/407 X |
| 4,747,331 | 5/1988 | Policella | 83/762 |
| 4,964,323 | 10/1990 | Fortney . | |
| 5,383,384 | 1/1995 | Dennis . | |
| 5,386,755 | 2/1995 | Schneider et al. | 83/762 X |
| 5,440,959 | 8/1995 | Bindon et al. | 83/167 X |
| 5,461,956 | 10/1995 | Petersen et al. | 83/221 |
| 5,542,346 | 8/1996 | Shenk | 99/400 |
| 5,566,602 | 10/1996 | Dennis . | |
| 5,718,158 | 2/1998 | Rogge | 83/762 |

*Primary Examiner*—Maurina Rachuba
*Assistant Examiner*—T. Anthony Vaughn
*Attorney, Agent, or Firm*—James W. Miller

[57] ABSTRACT

A slicer is provided for use in conjunction with a manually manipulated knife for cutting slices off one end of a loaf of a food product, such as a loaf of bread, a loaf of meat, a loaf of cheese, etc. The slicer includes a U-shaped channel in which the food product loaf is contained with one end of the loaf being in engagement with an end wall. The channel is inclined to the horizontal to cause the loaf to self feed down into engagement with the end wall. A knife slot is provided in the channel to allow a slice having a pre-determined thickness to be provided. The entire end wall moves towards or away from the knife slot to adjust the thickness of the cut slice. A tool or implement is inserted into the channel to hold a bagel therein during slicing of the bagel.

18 Claims, 2 Drawing Sheets

FOOD PRODUCT SLICER

TECHNICAL FIELD

This invention relates to a slicer for holding a loaf of bread, or a similar food product, to allow slices to be cut off the end of the loaf by a manually held and manipulated knife.

BACKGROUND OF THE INVENTION

It is estimated that more than two million breadmaking machines have now been purchased and that the number is growing fast. The reason for this popularity is largely that there is a widespread appetite for truly fresh bread, fresher than can be bought in stores. The yen for bread freshly out of the oven poses the problem that fresh, warm bread is not easily sliced into neat slices of any desired thickness and of equal thickness in all parts of the slice. This yen is what led to the development of the slicer herein described. This device enables one to serve precisely these two purposes, i.e. to slice bread as soon as it has cooled enough to handle and to slice bread and many other food products evenly of precisley the desired thickness.

Food products of various types are often provided in large chunks or loaves which are typically sliced into relatively thin slices. For example, "deli" type meat products are usually provided in elongated loaf type form, and slices are cut from the end of the loaf as required. The same is true of many cheeses. While bread loaves can be bought in either cut or uncut form, most bread purchased in grocery stores might be pre-sliced, or the purchaser could have the store or bakery slice the bread if so desired. However, if the bread is not sliced at the store or bakery, or if the bread is home baked, then the user must cut slices in order to use the bread.

While specialized slicers are used in commercial establishments for slicing meat or bread products, these slicers are relatively large, motorized products which are not generally suitable for home use. Many meat slicers include a rotatable, motorized cutting blade with the loaf of meat being held against the cutting blade and moved back and forth across the blade to cut sequentially slices of meat off the end of the loaf. Bread slicers often include a plurality of vertical, reciprocating saw blades spaced apart by the thickness of the desired slices, with the bread loaf being pushed through the saw blades to slice the entire loaf in one action. Again, these slicers are generally too expensive for home use.

In addition, cutting an entire loaf of bread all at once is disadvantageous if the bread is not consumed quickly, particularly for home baked bread lacking preservatives, since the bread tends to dry out rapidly. It would be better to cut off just individual slices as needed and leave the rest of the bread loaf intact.

Obviously, a loaf of bread could be cut simply by holding the loaf of bread in place with one hand and using the other hand to manipulate a knife to cut slices off the end of the loaf. However, this is not ideal for a number of reasons. Gripping the loaf tightly with the hand tends to crush the bread while it is being cut. In addition, it is difficult to cut slices having a consistent thickness, or to adjust easily the thickness of the sliced bread, simply using an unsupported knife. Finally, if the user is not careful, there is a possibility that the user might accidentally cut his or her fingers with the knife blade.

Various devices are known for use with a manual knife to help hold a loaf of bread when slicing the bread. Many of these devices comprise channel shaped boxes in which the loaf of bread is placed, with the side walls of the boxes having a plurality of knife slots spaced along the length thereof so that multiple slices can be cut one after another along the length of the loaf. Often, these slots are spaced at different distances from one another to allow the bread slices to have various thicknesses. U.S. Pat. Nos. 1,072,450 to Hamblin, 1,131,333 to Coon and 4,964,323 to Fortney disclose devices of this type.

While these devices are more effective than simply using an unsupported knife to slice the bread, they have various disadvantages. For one thing, the knife slots in each side wall have to be precisely aligned with all the other slots in the other side wall to allow the knife blade to pass across the width of the box to slice the bread. The need for such an alignment, and the use in the first place of multiple slots spaced apart in an array of such slots, makes the construction of such a device relatively labor intensive, and accordingly more complex and expensive. In addition, to adjust the thickness of the bread slices, the end of the bread loaf has to be positioned appropriately adjacent to those knife slots having the right spacing from adjacent slots. This can be difficult and time consuming to do, thus making the device complex to use if slices having different thicknesses are required.

The Applicant has two prior patents, namely U.S. Pat. Nos. 5,383,384 and 5,566,602, which show a slicing device having a single set of knife slots at one end of a bread loaf supporting channel. The thickness of the slices are adjusted by slipping one or more thickness adjusting plates into the channel between the knife slots and an end wall. This device is less expensive to construct and much simpler to use than many of the prior art devices described above. However, the thickness adjusting plates have to be on hand in order to be used. If the thickness adjusting plates are lost or misplaced, the thickness of the slices cannot be adjusted.

U.S. Pat. No. 252,325 to Moore shows a bread cutter with an adjustable gage that can move towards or away from the knife slot to adjust the slice thickness. The cutter of Moore is not in the form of a U-shaped channel but has only one side wall, a bottom wall, and the aforementioned gage. In addition, the gage has a very small width such that the end of the bread loaf would mostly stick out to the side past the gage and not be in contact with the gage. Thus, it would be easy to cock or tilt the loaf relative to the gage resulting in slices with inconsistent thickness. Moreover, the knife is quite exposed to the user's fingers in the Moore device.

SUMMARY OF THE INVENTION

It is one aspect of this invention to provide a slicer for holding food product loaves during a slicing operation which is simple, durable and easy to use, and which can also be easily adjusted to vary the thickness of the slices that are being cut.

These and other aspects of this invention are provided by a food product slicer for use with a knife for cutting slices of food product from a loaf of food product. The slicer comprises a substantially planar bottom wall on which a loaf of food product may be laid for cutting a slice of food product off one end of the loaf. Two transversely spaced apart, substantially planar side walls are fixedly secured to the bottom wall along the sides thereof and with the bottom wall received between the side walls to define a generally U-shaped channel in which the loaf is received during a slicing operation. An upright, substantially planar end wall includes a front face against which the one end of the food product loaf may be abutted when cutting a slice off the one end of the loaf. The end wall is substantially perpendicular to the bottom wall and extends substantially the entire distance between the side walls. A means carried on the side walls is provided for guiding an elongated knife blade of a hand-held knife in a direction parallel to the end wall for cutting a food product slice having a thickness determined by the distance between the front face of the end wall and the knife guiding means. The end wall is movable relative to the side walls to move back and forth between the side walls towards and away from the knife guiding means to vary the thickness of a cut slice.

BRIEF DESCRIPTION OF THE DRAWINGS

This invention will be described more completely hereafter in the Detailed Description, when taken in conjunction with the following drawings, in which like reference numerals refer to like elements throughout.

DETAILED DESCRIPTION

Figure 1:
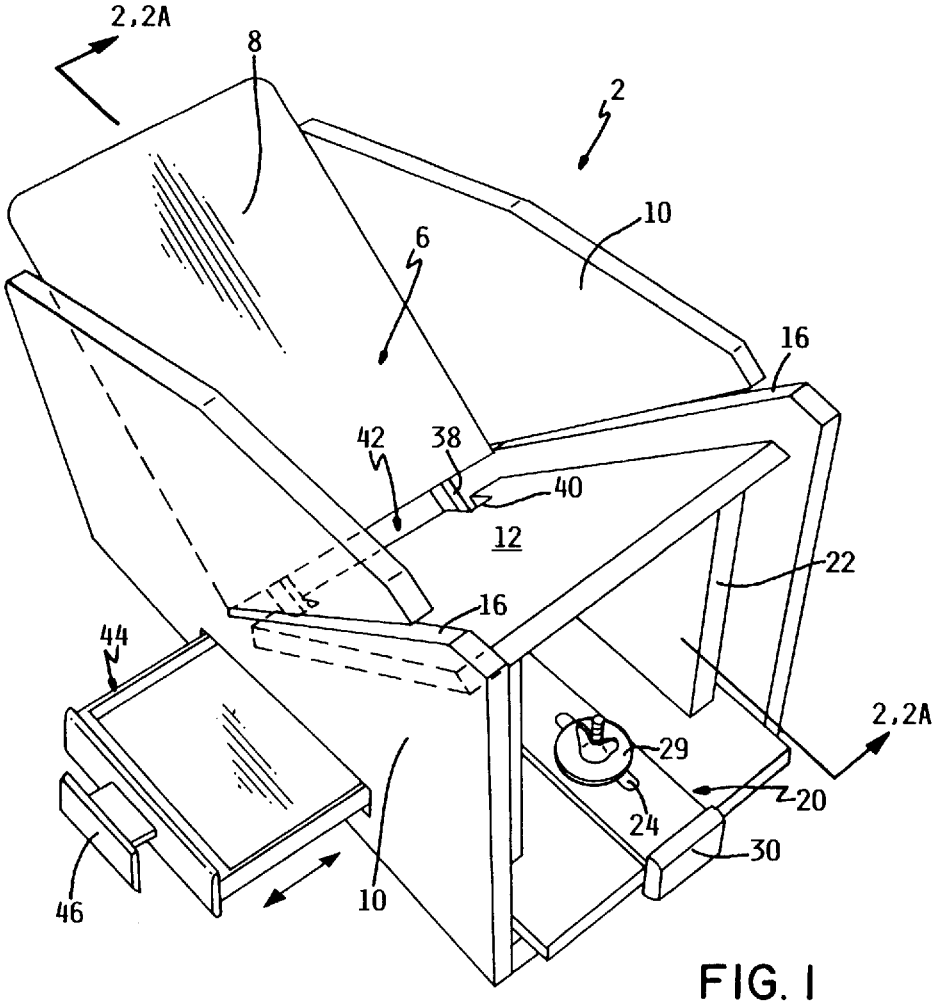
FIG. 1 is a perspective view of a first embodiment of a bread slicer according to the present invention.

Referring first to FIG. 1, a first embodiment of a bread slicer according to this invention is illustrated as 2. Slicer 2 is intended for use with a bread slicing knife having a handle and an elongated knife blade, preferably a serrated blade. The knife is not shown in the drawings, but is received in a knife guiding means provided in slicer 2. The knife does not itself necessarily form a part of slicer 2 of this invention, though some type of knife must obviously be used to cut slices of bread off the bread loaf. As a practical matter, many people already own bread slicing knives and slicer 2 could be sold without a knife such that the purchaser would use one of the knives already owned by the purchaser with slicer 2. However, if desired, a knife could also be packaged with and sold as part of slicer 2, forming a portion thereof.

Slicer 2 comprises a generally U-shaped trough or channel 6 for holding a loaf of bread therein. A single loaf of bread can be received in channel 6. Channel 6 is formed by a bed or bottom wall 8 forming a substantially planar surface on which the bread loaf is received and by two transversely spaced apart side walls 10 which extend upwardly from bottom wall 8 such that the bread loaf is received between side walls 10. A plurality of feet 11 are provided at suitable spots on the underside of side walls 10, or on the underside of a horizontal reinforcing wall 13 that further unites side walls 10, to allow slicer 2 to be supported on a 4 horizontal surface, such as a table or countertop. Feet 11 can be made of rubber or some suitable material that will not mar or scratch the table or countertop.

One end of the U-shaped channel 6 formed by the bottom and side walls 8 and 10 is closed off by a generally upright end wall 12 set perpendicularly to bottom wall 8. One end of the bread loaf is abutted against a front face 14 of end wall 12 when the bread loaf is received in channel 6. Desirably, channel 6 is sloped relative to the horizontal so that the bread loaf will be fed by gravity down into engagement with end wall 12, as shown in FIG. 1. This is one aspect of this invention that facilitates and eases the bread slicing action. The angle of inclination of bottom wall 8 relative to a horizontal plane could obviously be varied, but is preferably in the range of from 30° to 45° relative to the horizontal. In fact, it is preferred that bottom wall 8 be inclined at 45° relative to the horizontal to ensure that bread crumbs will fall down the bottom wall 8 towards end wall 12.

Figure 2:
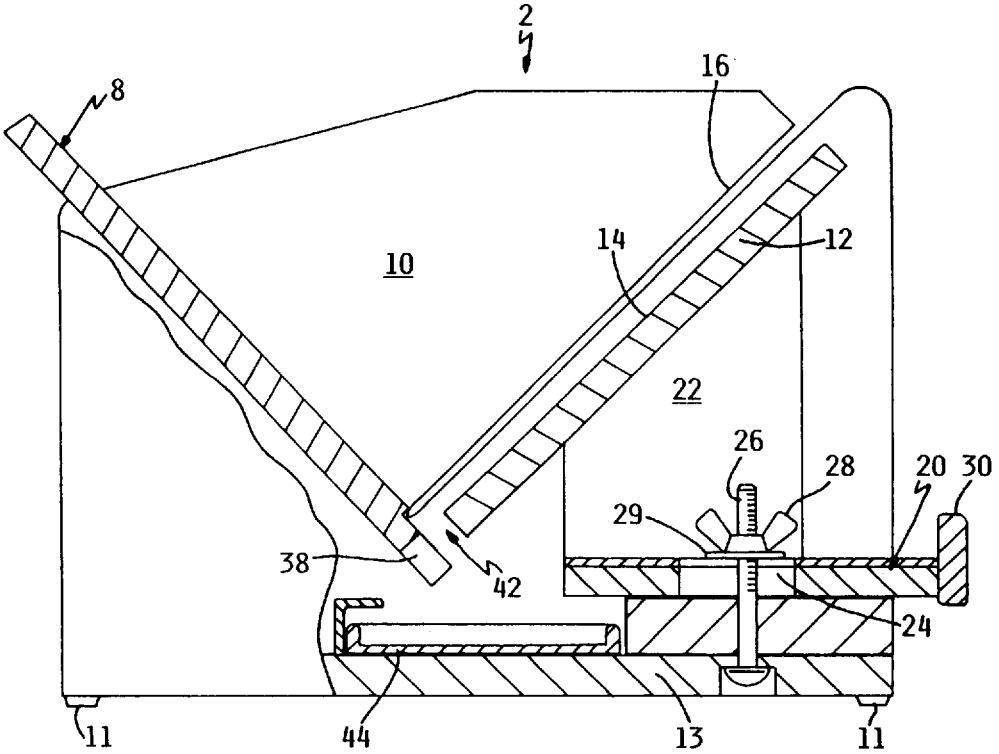
FIG. 2 is a cross-sectional view of the bread slicer shown in FIG. 1 taken along lines 2—2 in FIG. 1.

Referring now to FIGS. 1 and 2, slicer 2 includes means for guiding the blade of the bread slicing knife in a direction parallel to front face 14 of end wall 12. This knife guiding means includes elongated knife slots 16 that extend down through each side wall 10 from the top of side wall 10 to bottom wall 8 of channel 6. Knife slots 16 in side walls 10 are longitudinally aligned with one another to allow the knife blade to pass down through both slots simultaneously with the handle of the knife being located outside of the side walls of slicer 2.

One aspect of this invention is to provide a slicer 2 having means for easily and quickly adjusting the thickness of the bread slices being cut by slicer 2. This invention provides that the entire end wall 12 is movable towards or away from knife slots 16. Thus, if end wall 12 is positioned at a first distance from knife slots 16 and is then moved closer to the knife slots 16, the thickness of the cut slice will be decreased. Conversely, if the end wall is moved further away from the knife slots 16, the thickness of the cut slice will be increased.

Referring to FIGS. 1 and 2, a first embodiment of a slicer 2 having a movable end wall 12 is depicted. In this embodiment, end wall 12 is supported on a horizontal slide 20 by triangular support walls 22. Slide 20 includes a slot 24 which receives the shank of an upwardly extending bolt 26. A wing nut 28 and washer 29 are received on the shank of bolt 26 and can be used to lock or secure end wall 12 in an adjusted position by tightening wing nut 28 against the top of slide 20. The outer end of slide 20 includes an upwardly extending handle 30 that the user can grip to move slide 20 back and forth on slicer 2.

Assuming wing nut 28 is loosened so as to permit movement of slide 20 on slicer 2, slide 20 can be moved back and forth by the length of slot 24. Referring to FIG. 2, if slide 20 is pulled outwardly until the shank of bolt 26 engages the innermost side of slot 24, then end wall 12 will be pulled away from knife slots 16 by the maximum permitted amount to cause the thickest bread slice to be provided by slicer 2. Conversely, if slide 20 is pushed in its maximum amount until the shank of bolt 26 engages the outermost side of slot 24, then end wall 12 will be closest to the knife slots to provide the thinnest slice. Slide 20 can be positioned anywhere in between these two positions to adjust the slice thickness to something in between the thickest and thinnest possible slice. Again, once a desired position of slide 20 is reached, slide 20, and hence end wall 12, can be locked in place by tightening wing nut 28 on bolt 26.

Bottom wall 8 of slicer 2 has two forwardly extending fingers 38 that mate or interfit with two notches 40 on end wall 12. Fingers 38 support the slice being cut off the end of the bread loaf and prevent that slice from falling downwardly between bottom wall 8 and end wall 12. Bottom wall 8 and end wall 12 are not secured to one another giving the adjustability required for end wall 12, but normally have a gap 42 present therebetween as shown in FIG. 1 in the various adjusted positions of end wall 12. This gap forms a natural opening for bread crumbs with any such bread crumbs simply falling down through gap 42 into the space between side walls 10.

To ease in the task of catching and removing bread crumbs, a pull out drawer 44 is provided in slicer 2 extending between side walls 10 and located directly beneath gap 42. Drawer 44 has a handle 46 for allowing drawer 44 to be pulled out or pushed in relative to slicer 2 as indicated by the arrows in FIG. 1. Drawer 44 has a shallow depth for collecting bread crumbs. Thus, bread crumbs can be removed simply by periodically pulling out drawer 44 and dumping the drawer 44 into a trash bag or the like to dispose of the bread crumbs. Then, drawer 44 can simply be slid back into slicer 2. Thus, bread crumbs can be collected and removed easily and quickly without having to disassemble or even move slicer 2 from its position on the countertop.

Figure 2A:
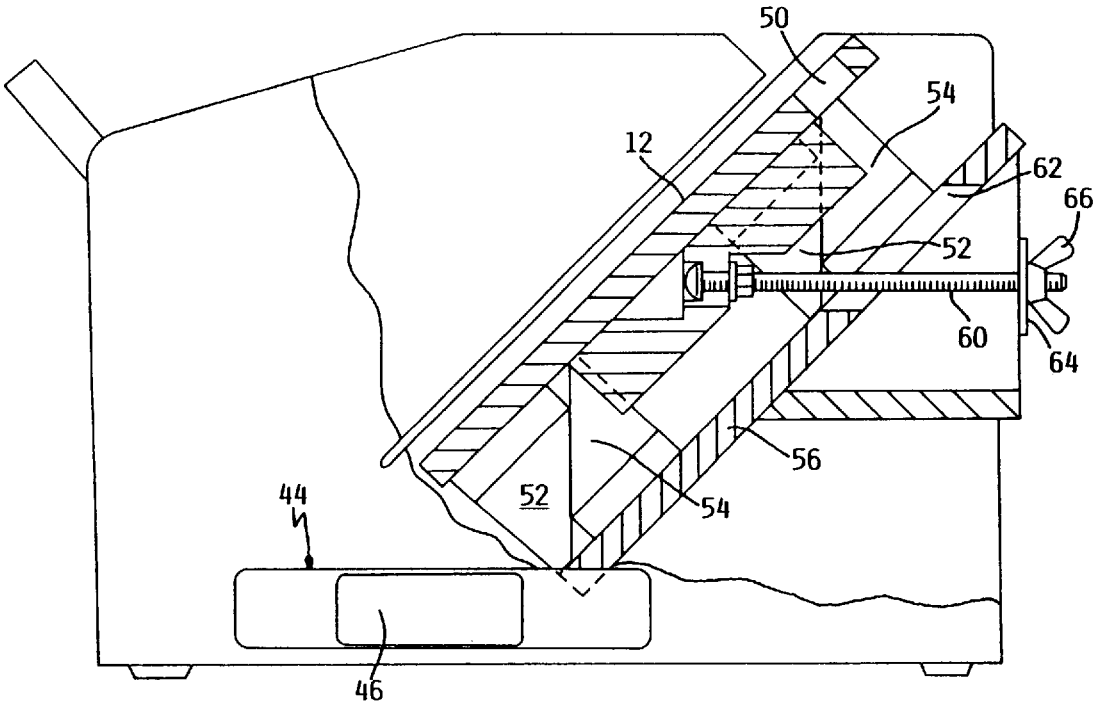
FIG. 2A is a cross-sectional view of a second embodiment of a bread slicer according to the present invention, FIG. 2A being similar to FIG. 2 in that it is taken along the same lines as FIG. 2 such lines being indicated as 2A—2A in FIG. 1.

FIG. 2A shows an alternative way of moving end wall 12 towards or away from knife slots 16. In the first embodiment of slicer 2 shown in FIGS. 1 and 2, end wall 12 could be moved back and forth simply by a horizontal movement of slide 20, effected by pulling or pushing on handle 30. In the second embodiment of FIG. 2A, the same movement of end wall 12 is effected by pulling up or pushing down on end wall 12.

Referring now to FIG. 2A, end wall 12 is provided at its top end with an opening 50 large enough to receive the user's hand. This allows the user to pull up or push down on end wall 12. In addition, end wall 12 has some downwardly extending triangular shaped surfaces 52 that rest against or on top of some triangular cams 54 that are fixed to the frame of slicer 2 by a fixed support wall 56. Thus, if the user grips opening 50 and pulls vertically up on end wall 12, the sliding interaction between surfaces 52 and cams 54 moves the end wall 12 closer to the knife slots 16. Similarly, if the user pushes down on end wall 12, the same sliding interaction between surfaces 52 and cams 54 allows the end wall 12 to drop down away from knife slots 16.

A means for locking or securing end wall 12 in place is used in the embodiment of FIG. 2A. An elongated bolt 60 extends horizontally from end wall 12 through a slot 62. The outer end of bolt 60 carries a washer 64 and wing nut 66 that can be tightened against a fixed surface on slicer 2. Thus, tightening wing nut 66 will hold end wall 12 in an adjusted position in the embodiment of FIG. 2A just as tightening wing nut 28 does the same in the embodiment of FIGS. 1 and 2.

In using slicer 2, if a bread slice is desired having a smaller thickness than the thickness then being provided by slicer 2, it is required that end wall 12 be moved closer to knife slots 16. Thus, the wing nuts 28 or 66 will be loosened, and slide 28 pushed inwardly in FIG. 2 or end wall 12 pulled upwardly in FIG. 2A, respectively, to move end wall 12 closer to knife slots 16. Wing nuts 28 or 66 can then be retightened to lock end wall 12 in this adjusted position. If a knife is then inserted through knife slots 16 and is used to cut a slice from the loaf of bread, this cut slice will now be thinner than that previously provided by slicer 2.

To increase the thickness of a cut slice, the reverse will be true. Namely, the slide 28 will be pulled outwardly in the FIG. 2 embodiment or the end wall 12 will be pushed downwardly in the FIG. 2A embodiment to increase the distance between the face 14 of end wall 12 and the knife slots 16.

It is desirable to use a bread pusher plate or member, of the type shown in the Applicant's prior U.S. Pat. Nos. 5,383,384 and 5,566,602 which are hereby incorporated by reference, to engage against the butt end of the loaf and to help force the loaf against end wall 12. The pusher plate is of such size and shape at to make it impossible for the fingers of the non-knife holding hand to come into contact with the knife when slicing the last two or three slices left in the loaf. In addition, the pusher plate is especially desirable when slicing bagels since it is necessary to press hard on the bagel so as to compress it enough to make the two resulting slices be of equal thickness. The pusher plate helps avoid damage to one's fingers in this instance.

Figure 3:
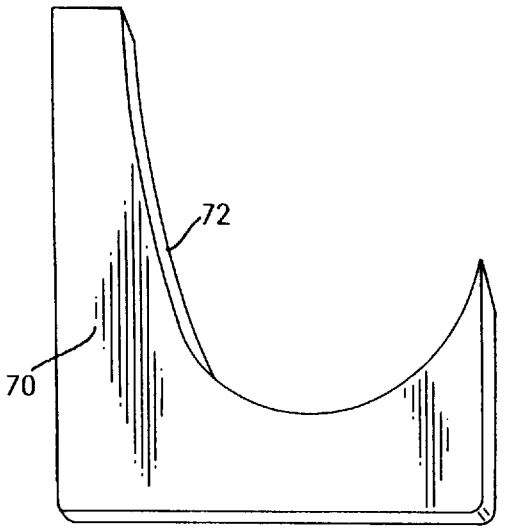
FIG. 3 is a plan view of a bagel holding implement for use with any of the bread slicers shown herein.

FIG. 3 shows a tool or implement 70 for use in cutting bagels or similar round shaped items in slicer 2. Normally, the U-shaped channel 6 of slicer 2 is sized to receive a loaf of bread therein. Thus, if a bagel is inserted into channel 6 between side walls 10, it will roll back and forth on bottom wall 8 and not be securely held.

To prevent this, a tool 70 formed as a planar plate is provided. Tool 70 has a width which is designed to slip snugly into the slicer between side walls 10 and has a thickness of approximately one-half inch. Tool 70 is placed against end wall 12 between end wall 12 and knife guiding slots 16. Obviously, when using tool 70, end wall 12 must be adjusted to provide slices having a thickness slightly more than the thickness of tool 70, in this case slices having a thickness slightly more than one-half inch. Otherwise, tool 70 would extend at least partially into slots 16 and prevent the proper operation of the knife.

Tool 70 also includes an arc shaped opening 72 into which the bagel is inserted. When tool 70 is slipped into the slicer and a bagel is inserted into the tool with the bagel resting against or within the arc shaped opening 72, tool 70 will hold the bagel firmly without the bagel rolling back and forth between the side walls 10 of channel 6. Again, the use of a pusher plate against the other side of the bagel is advised to help compress the bagel and to protect one's fingers during the slicing action.

The 45° slope of bottom wall 8 contributes to the stability of slicer 2. The manual pressure of the non-knife holding hand on the butt of the loaf, in conjunction with the slope, means that slicer 2 will be firmly held on the counter. The fingers of the user's non-knife holding hand must pass over the butt of the loaf so as to rest on the top of the side wall 8 or 10 farthest from the user while the palm and heel of this hand presses down on the butt end of the loaf. This pressure both helps force the loaf against end wall 12, but also applies downward pressure on slicer 2 that makes it quite stable.

Slicer 2 has been described herein for use with loaves of bread. However, it is not limited for use with only bread, but could be used to cut off slices from various food products that might be provided in larger loaves or chunks, such as slices of meat from loaves of processed meat or slices of cheese from cheese loaves.

Slicer 2 of this invention is especially helpful if one wishes to slice bread very freshly out of the oven. Slicer 2 is able to cut slices if one waits a few minutes, e.g. less than ten minutes, from the time the bread leaves the oven until the bread has cooled enough to handle. Slicer 2 can easily select different thicknesses for the slices, will consistently provide slices of the selected thickness, and is easy to use. In addition, slicer 2 collects the crumbs generated by the slicing to keep the kitchen and countertops neat and clean and to hold the crumbs for reuse in recipes by the chef. Slicer 2 can accommodate not only the standard one-and-one half pound loaf, but also one and two pound loaves.

Various modifications of this invention will be apparent to those skilled in the art. Accordingly, this invention is to be limited only by the appended claims.

I claim:

1. A food product slicer for use with a hand-held knife for cutting slices of food product from a loaf of food product, which comprises:

(a) a substantially planar bed on which a loaf of food product may be laid for cutting a slice of food product off one end of the loaf;

(b) two transversely spaced apart, substantially planar side walls which are fixedly secured to the bed along the sides thereof and with the bed received between the side walls to define a generally U-shaped channel in which the loaf is received during a slicing operation;

(c) an upright, substantially planar end wall which includes a front face against which the one end of the food product loaf may be abutted when cutting a slice off the one end of the loaf, wherein the end wall is substantially perpendicular to the bed and extends transversely between the side walls;

(d) means carried on the side walls for guiding an elongated knife blade of a hand-held knife in a direction parallel to the end wall for cutting a food product slice having a thickness determined by the distance between the front face of the end wall and the knife guiding means;

(e) wherein the end wall is movably carried relative to the side walls to move longitudinally back and forth between the side walls towards and away from the knife guiding means to vary the thickness of a cut slice; and (f) wherein the end wall and bed of the slicer have a gap therebetween in adjusted positions of the end wall, and wherein the bed has forwardly extending fingers that protrude into the gap to support the one end of the loaf and the cut slice thereon.

2. A food product slicer as recited in claim 1, wherein the bed is inclined relative to the horizontal to have an upper and a lower end, and wherein the end wall is proximate the lower end of the bed to allow the loaf to slide downwardly in the U-shaped channel formed between the side walls and the bed until it engages against the end wall.

3. A food product slicer as recited in claim 1, wherein an upwardly facing drawer is located between the side walls and beneath the gap between the bed and end wall for catching crumbs.

4. A food product slicer as recited in claim 3, wherein the drawer is slidably carried between the side walls to be capable of being pulled out from between the side walls to be dumped and to be pushed back into place between the side walls after such dumping.

5. A food product slicer as recited in claim 1, wherein the fingers on the bed are received in notches provided in the end wall of the slicer in adjusted positions of the end wall.

6. A food product slicer as recited in claim 1, further including means for locking or securing the end wall in an adjusted position of the end wall.

7. A food product slicer as recited in claim 1, further including means for mounting the end wall for movement back and forth on the slicer in a substantially horizontal direction.

8. A food product slicer as recited in claim 7, further including a slide carried between the side walls of the slicer for movement back and forth in a substantially horizontal direction, and wherein the end wall is fixed to the slide for movement therewith.

9. A food product slicer as recited in claim 8, further including a handle on the slide extending exteriorly beyond the side walls to allow the slide to be gripped and moved.

10. A food product slicer as recited in claim 8, wherein the bed is inclined relative to the horizontal to have an upper and a lower end, wherein the end wall is proximate the lower end of the bed to allow the loaf to slide downwardly in the U-shaped channel formed between the side walls and the bed until it engages against the end wall, and wherein the end wall is secured to the slide by at least one support wall having an inclined upper edge for holding the end wall at an inclined angle relative to the horizontal so as to remain substantially perpendicular to the bed.

11. A food product slicer as recited in claim 1, further including means for mounting the end wall for movement back and forth on the slicer in at least a partially vertical direction, wherein the mounting means includes means for camming the end wall towards and away from the knife guiding means during such vertical movement.

12. A food product slicer as recited in claim 11, further including an opening adjacent a top edge of the end wall for allowing the user to pull up or push down on the end wall.

13. A food product slicer for use with a knife for cutting slices of food product from a loaf of food product, which comprises:

(a) a bed on which a loaf of food product may be laid for cutting a slice of food product off one end of the loaf;

(b) an upright end wall having a front face which is substantially perpendicular to the food product loaf to allow the one end of the food product loaf to be abutted against the front face of the end wall;

(c) means fixed relative to the end wall for guiding a knife blade in a direction parallel to the end wall for cutting a food product slice having a thickness equal to the distance between the front face of the end wall and the knife guiding means;

(d) wherein the end wall is movable towards and away from the knife guiding means to adjust the thickness of the cut slice;

(e) a pull out drawer positioned beneath the bed and end wall adjacent the knife guiding means to collect bread crumbs generated when cutting a food product slice, the pull out drawer being removable to allow the bread crumbs to be easily collected for use in cooking or for disposal; and (f) further including two slots in a bottom side of the end wall for interdigitation with two fingers on the bed which fingers provide adequate surface area to support the food product loaf during slicing.

14. A food product slicer as recited in claim 13, wherein the bed is bounded on each side thereof by an upright side wall such that the side walls and bed form a generally U-shaped channel.

15. A food product slicer as recited in claim 14, wherein the end wall spans across the bed substantially the entire distance between the side walls.

16. A food product slicer as recited in claim 14, further including a planar plate having an opening therein into which one side of a bagel may be inserted, and wherein the plate is insertable into the U-shaped channel for holding a bagel in place in the channel without the bagel sliding back and forth with each stroke of the knife.

17. A food product slicer for use with a knife for cutting slices of food product from a loaf of food product, which comprises:

(a) a bed on which a loaf of food product may be laid for cutting a slice of food product off one end of the loaf;

(b) an upright end wall which includes a front face which is substantially perpendicular to the food product loaf to allow the one end of the food product loaf to be abutted against the front face of the end wall;

(c) means fixed relative to the end wall for guiding a knife blade in a direction parallel to the end wall for cutting a food product slice having a first predetermined thickness equal to the distance between the front face of the end wall and the knife guiding means, the knife guiding means comprising opposed side wall portions having aligned knife slots extending therethrough which knife slots are longitudinally aligned with one another to allow a blade of the knife to extend between and through the aligned knife slots; and (d) further including means for holding a bagel in place without the bagel sliding back and forth on the bed as the knife is propelled in cutting, wherein the bagel holding means is a plate that lies flat against the end wall when the Plate is in use, the plate having an upwardly facing edge and an opening in the upwardly facing edge which opening is shaped for abutting against a lower side of the bagel.

18. A food product slicer for use with a hand-held knife for cutting slices of food product from a loaf of food product, which comprises:

(a) a substantially planar bed on which a loaf of food product may be laid for cutting a slice of food product off one end of the loaf;

(b) two transversely spaced apart, substantially planar side walls which are fixedly secured to the bed along the sides thereof and with the bed received between the side walls to define a generally U-shaped channel in which the loaf is received during a slicing operation;

(c) an upright, substantially planar end wall which includes a front face against which the one end of the food product loaf may be abutted when cutting a slice off the one end of the loaf, wherein the end wall is substantially perpendicular to the bed and extends transversely between the side walls;

(d) means carried on the side walls for guiding an elongated knife blade of a hand-held knife in a direction parallel to the end wall for cutting a food product slice having a thickness determined by the distance between the front face of the end wall and the knife guiding means; and (e) wherein the end wall is slidably carried relative to the side walls to slide longitudinally back and forth between the side walls towards and away from the knife guiding means to vary the thickness of a cut slice, the end wall remaining between the side walls during the sliding motion of the end wall used to vary the thickness of a cut slice.

* * * * *